US006904878B2

(12) United States Patent
Drew

(10) Patent No.: US 6,904,878 B2
(45) Date of Patent: Jun. 14, 2005

(54) INTERNAL COMBUSTION ENGINE WITH NOVEL FUEL/AIR DELIVERY SYSTEM

(76) Inventor: Julius Drew, 3310 Cotton Mill Dr., Apt. 301, Raleigh, NC (US) 27612

( * ) Notice: Subject to any disclaimer, the term of this patent is extended or adjusted under 35 U.S.C. 154(b) by 0 days.

(21) Appl. No.: 10/682,097

(22) Filed: Oct. 10, 2003

(65) Prior Publication Data

US 2005/0076878 A1 Apr. 14, 2005

(51) Int. Cl.[7] ..... F02B 75/28
(52) U.S. Cl. ..... 123/56.3; 123/193.4; 123/193.6
(58) Field of Search ..... 123/73 R, 59 BS, 123/193.4, 193.6, 65 S, 56.3–56.7

(56) References Cited

U.S. PATENT DOCUMENTS 3,901,093 A * 8/1975 Brille ..... 74/60
4,478,180 A * 10/1984 Fujikawa et al. ..... 123/58.6
5,009,207 A * 4/1991 Merritt ..... 123/261
5,115,768 A * 5/1992 Peschka et al. ..... 123/1 A
5,398,653 A * 3/1995 Merritt ..... 123/292
5,517,953 A * 5/1996 Wiesen ..... 123/51 R
5,638,778 A * 6/1997 James ..... 123/56.6
5,701,864 A * 12/1997 Tanigawa et al. ..... 123/290
6,279,520 B1 * 8/2001 Lowi, Jr. ..... 123/56.1
6,481,393 B1 * 11/2002 Drew ..... 123/56.1

* cited by examiner

*Primary Examiner*—Marguerite McMahon
(74) *Attorney, Agent, or Firm*—Jack Schuman

(57) ABSTRACT

Blower forces fuel/air mixture into bore of cylinder head against small diameter piston of compound piston assembly, forcing assembly down in engine cylinder, permitting fuel/air mixture to enter main cylinder of engine in which it is ignited. Exhaust forces assembly to bottom of its stroke. Roller bearings on large diameter piston engage sloping surface on swash plate causing rotation of drive shaft.

1 Claim, 4 Drawing Sheets

INTERNAL COMBUSTION ENGINE WITH NOVEL FUEL/AIR DELIVERY SYSTEM

BACKGROUND OF THE INVENTION

1. Field of the Invention

This invention relates, broadly speaking, to an internal combustion engine with a novel fuel/air delivery system.

More particularly, this invention relates to an internal combustion engine employing novel means to introduce a fuel/air mixture into the cylinder of the engine for combustion therein.

2. Description of the Prior Art

U.S. Pat. No. 6,481,393, issued Nov. 19, 2002, discloses an internal combustion engine employing, in the several embodiments shown therein, essentially the same internal structure as the present invention, except that in the present invention a different and entirely novel system for introducing a fuel/air mixture into the engine is employed.

U.S. Pat. No. 3,638,623 (1972) to Weinheimer, U.S. Pat. No. 3,786,790 (1974) to Plevyak and U.S. Pat. No. 4,462,345 (1984) to Routery were cited by the Patent Examiner during the course of prosecution of the application which issued as U.S. Pat. No. 6,481,393.

SUMMARY OF THE PRESENT INVENTION

One of the objects of the present invention is to provide a two-cycle internal combustion engine having a novel and efficient manner of introducing a fuel/air mixture into the cylinder of the engine.

Still other and further objects of the present invention will become apparent by reference to the accompanying specification and drawings, and to the appended claims.

Briefly, the forgoing objects are attained by providing, in a two-cycle internal combustion engine generally similar to any of the types shown in U.S. Pat. No. 6,481,393, said engine having, among other things, a cylinder, a cylinder head mounted within the cylinder, and a compound piston assembly comprising a small diameter piston slidably engaging through piston rings a central bore in the cylinder head, and a large diameter main piston slidably engaging through piston rings the inside wall of the cylinder, the improvement comprising a blower, a conduit communicating between the source of a fuel/air mixture and the inlet of the blower, and another conduit communicating between the outlet of the blower and the central bore in the cylinder head, whereby said blower forces the fuel/air mixture into the central bore in the cylinder head and against the free end of the small piston, thereby moving the compound piston assembly within the cylinder permitting the fuel/air mixture to enter the cylinder where it is ignited.

DESCRIPTION OF THE DRAWINGS

Referring now to the drawings, in which like numerals represent like parts in the several views.

DESCRIPTION OF THE PREFERRED EMBODIMENTS

Figure 1:
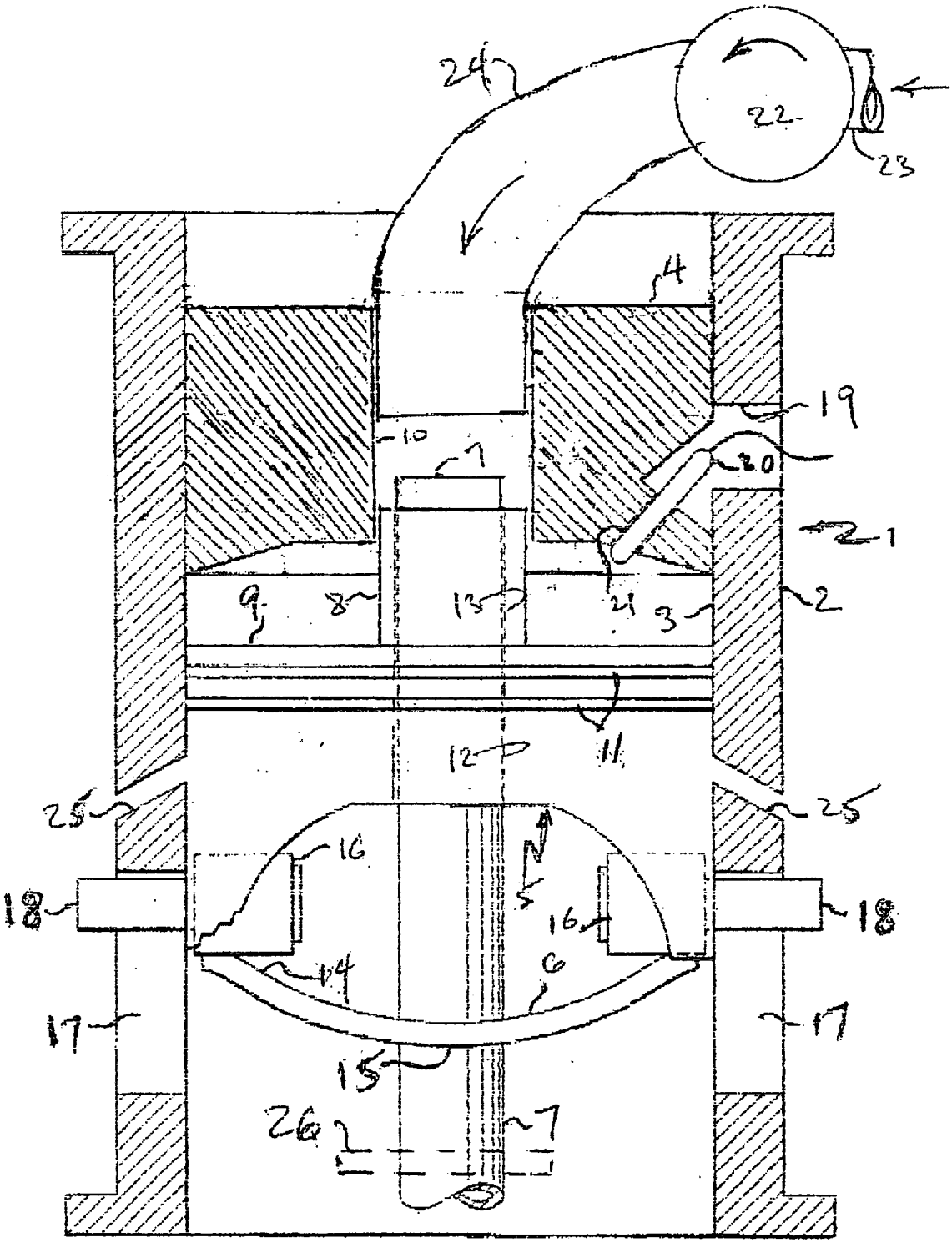
FIG. 1 represents, diagrammatically and not to scale, a longitudinal medial view, partially in section, of the engine, showing the compound piston assembly at the top of its stroke, showing the blower and conduit through which the fuel/air mixture is delivered to the cylinder of the engine, and showing one mechanism for imparting rotary motion to the drive shaft.

The present invention, i.e., the novel fuel/air delivery system, will be better understood after a review of the structure of a typical internal combustion engine having the compound piston assembly.

Engine 1 comprises hollow circular cylinder 2 having a central bore 3, a circular cylinder head 4 fixedly mounted within cylinder 2, circular compound piston assembly 5 longitudinally movable within cylinder 2 between a position at the top of its stroke and a position at the bottom of its stroke, and swash plate 6 secured to rotatable drive shaft 7. Compound piston assembly 5 is constituted by a small diameter piston 8, and a hollow large diameter main piston 9, said pistons 8 and 9 being secured to each other. Small diameter piston 8 slidably engages bore 10 in cylinder head 4. Large diameter main piston 9 slidably engages, through piston rings 11, central bore 3 in cylinder 2.

Rotatable drive shaft 7 extends through the bore 12 of main piston 9 and through central bore 13 in small diameter piston 8.

Figure 2:
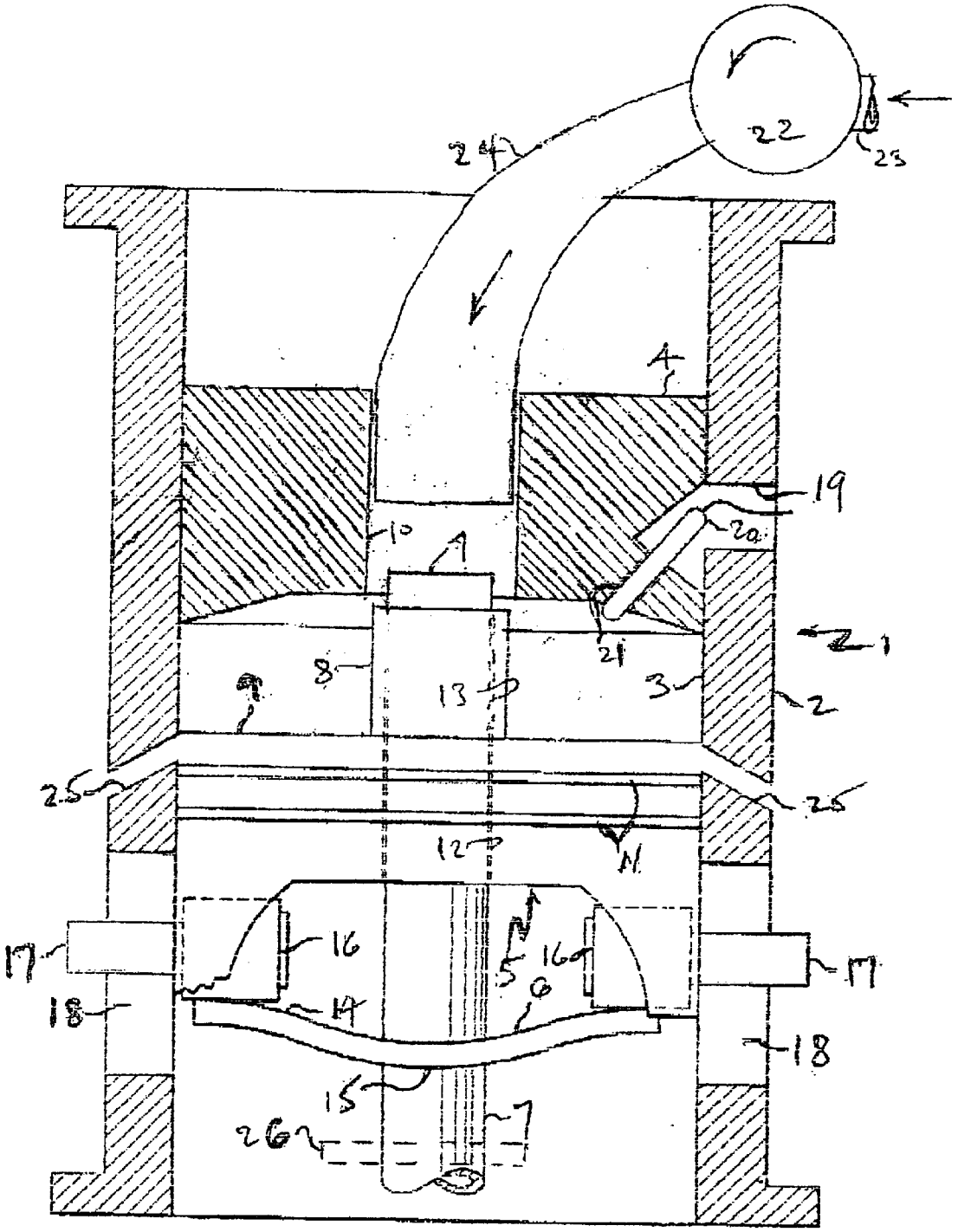
FIG. 2 represents a view similar to FIG. 1, showing the compound piston assembly In an intermediate position.
Figure 3:
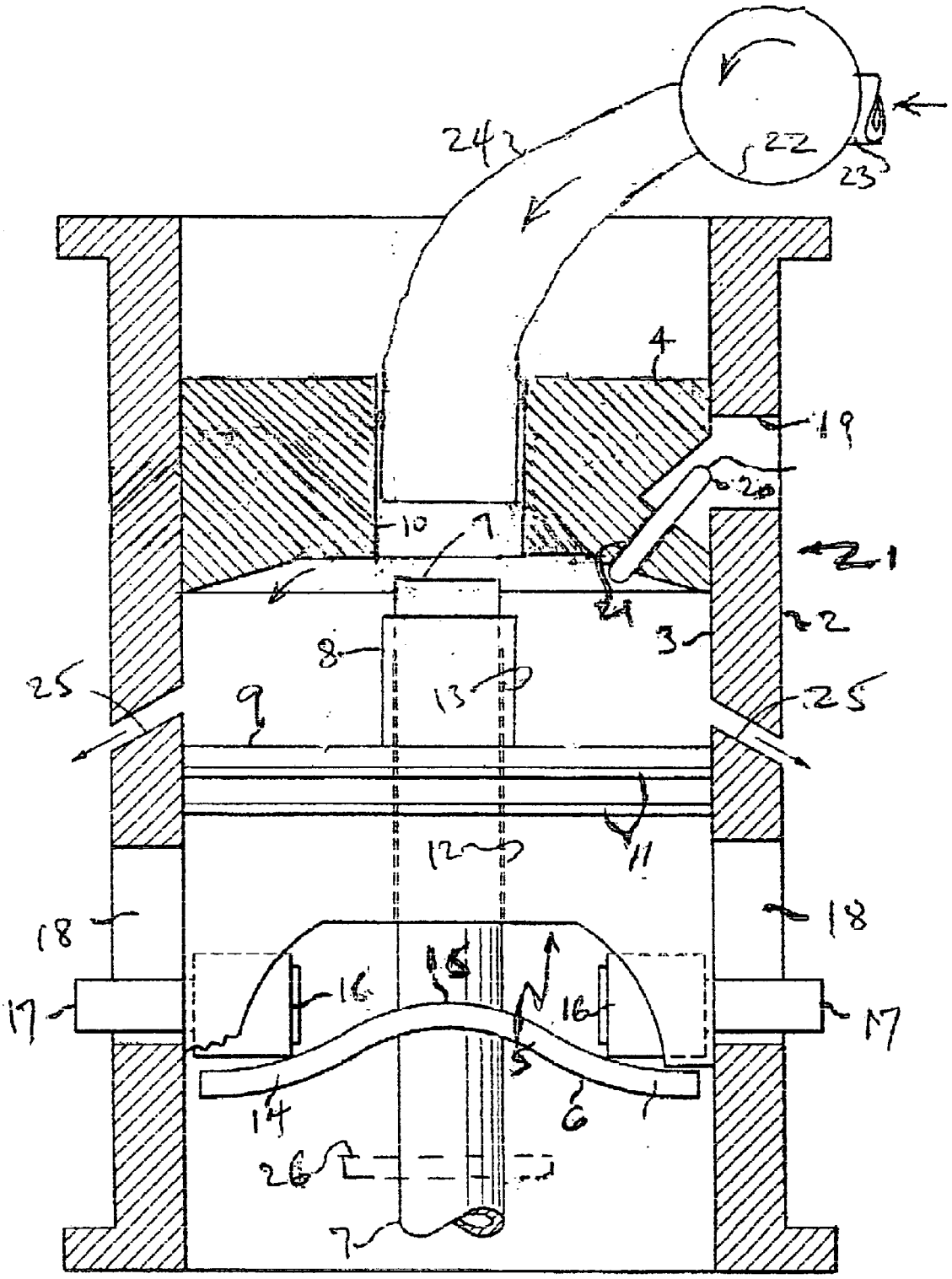
FIG. 3 represents A view similar to FIG. 1, showing the compound piston assembly at the bottom of its stroke.
Figure 4:
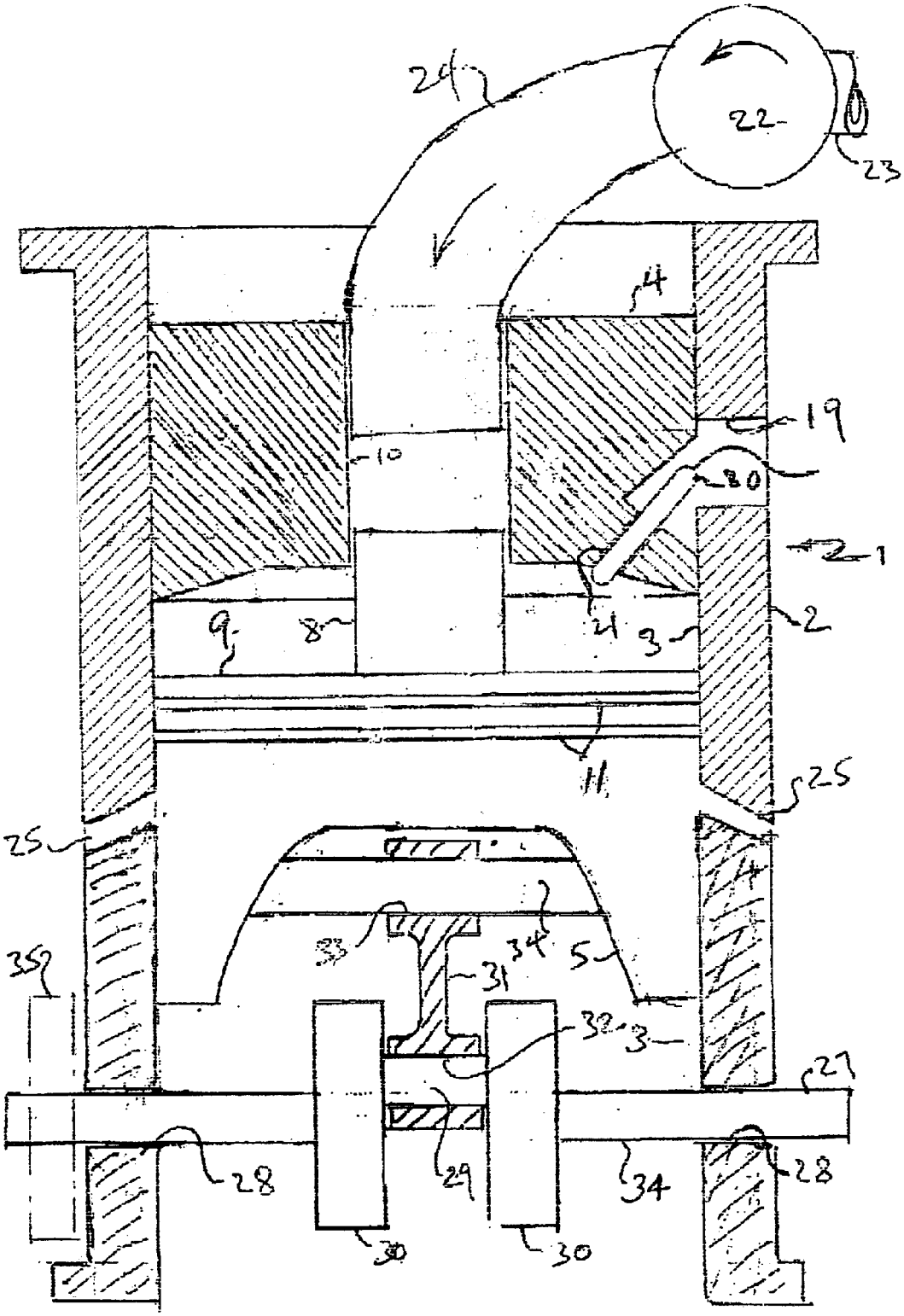
FIG. 4 represents a view similar to FIG. 1, showing another mechanism for imparting rotary motion to the drive shaft.

As shown in FIGS. 1–3, one mechanism for imparting rotary motion to drive shaft 7 comprises swash plate 6, otherwise known as a wobble plate, which is formed with a pair of gradual slopes 14 extending in one direction away from the center of swash plate 6, and with a pair of gradual slopes 15 extending in the opposite direction away from the center of swash plate 6, the said gradual slopes 14 and 15 being arranged alternately in equispaced relation around the swash plate 6. Swash plate 6 is positioned in cylinder 2 so that slopes 14 and 15 alternately engage roller bearings 16 rotatably mounted within the hollow of, and to, main piston 9. As swash plate 6 rotates, or is caused to rotate, the alternate engagement of slopes 14 and 15 with roller bearings 16 coincides with the longitudinal movement of compound piston assembly within cylinder 2.

In this preferred embodiment, swash plate 6 has two pair of gradual slopes 14 and two pair of gradual slopes 15 positioned alternately in equispaced relationship around the circumference of swash plate 6. In other words, slopes 14 and 15 are 90° apart. Slopes 14 on opposite edges of swash plate 6 must simultaneously engage roller bearings 16 which are positioned 180° apart on opposite sides of the hollow large diameter piston 9. Similarly, slopes 15 on opposite edges of swash plate 6 must simultaneously engage the said roller bearings 16.

The embodiment shown herein may employ a swash plate 6 with additional equispaced pairs of slopes 14 and 15.

The distances between those surfaces of slopes 14 and 15 which engage roller bearings 16, is equal to the length of travel of compound piston assembly. 5 within cylinder 2.

Compound piston assembly 5 is provided with stabilizing rods 17 projecting into slots 18 in cylinder 2, thus preventing compound piston assembly 5 from rotating within bore 3 of cylinder 2.

Aperture 19 in cylinder 2 permits the introduction of spark plug 20 through a threaded aperture 21 in cylinder head 4 so that the points of spark plug 20 are positioned within cylinder 2.

The novel system for introducing the fuel/air mixture into cylinder 2 of engine 1 will now be described.

Blower 22 continuously receives the fuel/air mixture from a source thereof through conduit 23 communicating with the inlet of the said blower 22.

Conduit 24 communicates at one end thereof with the outlet of the blower 22, and communicates at the other end thereof with bore 10 in cylinder head 4. It will be noted that that end of conduit 24 which extends into bore 10 fits the said bore 10. In other words, such end is circular and of substantially the same diameter as bore 10. Further, it will be noted that such end extends into bore 10 to a point short of small diameter piston 8 at the top of its stroke, thereby avoiding a collision in bore 10 between that end of conduit 24 extending into bore 10 and that end of small diameter piston 8 also extending into bore 10 and slidably engaging the interior thereof.

It will be noted that conduit 24 can be constituted by two pieces, one a circular ring extending into bore 10 and secured therein, and the other an ordinary length of conduit secured to the circular ring at the top thereof and extending to and secured to the outlet of blower 22.

In operating the embodiment of FIGS. 1–3, with compound piston assembly at the top of its stroke, fuel/air mixture from a source thereof is passed through conduit 23 to the inlet of blower 22, and is blown out of the outlet of blower 22 through conduit 24 into bore 10 above the free end of small diameter piston 8.

Due to the rotation of drive shaft 7, caused by a previous combustion cycle of operation, or by the momentum of fly wheel 26 useful in initially starting up engine 1, swash plate 6 rotates to remove the tops of slopes 14 or 15 away from engagement with roller bearings 16. At the same time, the pressure of the fuel/air mixture in bore 10 against the top or free end of small diameter piston 8 forces the forces the compound piston assembly 5 downwardly in central bore 3 of cylinder 2, thereby permitting the fuel/air mixture to access the space above large diameter piston 9 and below cylinder head 4. Spark plug 20 is fired to ignite the fuel/air mixture in said space above large diameter piston 9.

Such combustion of the fuel/air mixture in bore 3 of cylinder 2 produces exhaust gases of pressure sufficient to bear against the surface of large diameter piston 9 and force compound piston assembly 5 down to the bottom of its stroke, the exhaust gases passing out of engine 1 through exhaust ports 28. Roller bearings 16, forced downwardly by the descending compound piston assembly 5 against the surfaces of slopes 14 or 15 of swash plate 6 cause continued rotation of swash plate 6 and drive shaft 7 connected thereto.

Continued rotation of swash plate 6 brings the upper surfaces of the next pair of slopes 15 or 14 into contact with roller bearings 16 thereby elevating compound piston assembly 5 to the top of its stroke in preparation for the next cycle of operation.

FIGS. 1–3 show one means operatively interposed between the compound piston assembly 5 and drive shaft 7 to cause rotation of said drive shaft 7, such means being the roller bearings 16, swash plate 6 and surfaces 14 and 15 on swash plate 6.

Other means operatively interposed between the compound piston assembly 5 and drive shaft 7 to cause rotation of said drive shaft 7 will occur to those familiar with this art.

For example, the large diameter piston 9 of the compound piston assembly 5 may engage a cam in the drive shaft 7 which raises or lowers the large diameter piston 9 and thus the compound piston assembly 5 during the various steps in the cycle of operation of the engine 1.

Since modifications and changes which do not depart from the spirit of the invention as disclosed herein may readily occur to those skilled in the art to which this invention pertains, the appended claim should be construed as covering all suitable modifications and equivalents.

I claim:

1. Internal combustion engine comprising:

(a) a cylinder, (b) a first bore in said cylinder, (c) a cylinder head adjacent one end of said cylinder, (d) a second bore extending through said cylinder head, (e) means adapted to discharge a fuel/air mixture into said second bore, (f) a first piston having a first end and a second end, said first piston extending second bore or selectively standing outside of said second bore, (g) a main piston in said first bore and larger in diameter than said first piston, said main piston secured to the second end of said first piston and slidably engaging said first bore, (h) said fuel/air mixture in said second bore bearing against the first end of said first piston and forcing said first piston and said main piston secured thereto longitudinally in said cylinder, (i) whereby the exit of said first piston from said second bore permits said fuel/air mixture to enter the space in said cylinder between said main piston and said cylinder head, (j) ignition means extending into said first bore above said main piston and below said cylinder head, (k) whereby, upon ignition of said fuel/air mixture in the space between said main piston and said cylinder head, said main piston is forced by the products of combustion downwardly in said cylinder toward the bottom of its stroke, (l) a rotatable drive shaft, (m) shaft rotating means operatively interposed between said main piston and said drive shaft to cause rotation of said drive shaft upon longitudinal movement of said main piston in said cylinder, (n) wherein said drive shaft extends longitudinally through said compound piston assembly and said cylinder head.

* * * * *